US011505920B2

(12) United States Patent
Sherlock

(10) Patent No.: US 11,505,920 B2
(45) Date of Patent: Nov. 22, 2022

(54) GRADE CONTROL HAVING REAL TIME CYLINDER STOP LENGTHS

(71) Applicant: DEERE & COMPANY, Moline, IL (US)

(72) Inventor: Lance R. Sherlock, Potosi, WI (US)

(73) Assignee: DEERE & COMPANY, Moline, IL (US)

( * ) Notice: Subject to any disclaimer, the term of this patent is extended or adjusted under 35 U.S.C. 154(b) by 344 days.

(21) Appl. No.: 16/749,228

(22) Filed: Jan. 22, 2020

(65) Prior Publication Data

US 2020/0217045 A1 Jul. 9, 2020

Related U.S. Application Data

(63) Continuation-in-part of application No. 16/242,681, filed on Jan. 8, 2019, now abandoned.

(51) Int. Cl.
*E02F 9/22* (2006.01)
*E02F 3/84* (2006.01)
(Continued)

(52) U.S. Cl.
CPC ..... *E02F 9/2203* (2013.01); *E02F 3/7636* (2013.01); *E02F 3/844* (2013.01);
(Continued)

(58) Field of Classification Search
CPC ..... E02F 9/26; E02F 9/22; F15B 19/00
(Continued)

(56) References Cited

U.S. PATENT DOCUMENTS 5,471,147 A * 11/1995 Allen ..... G01D 5/248 324/636
5,814,724 A * 9/1998 Romkee ..... G01M 15/06 73/114.25
(Continued)

FOREIGN PATENT DOCUMENTS

DE 102010060550 A1 * 5/2012 ..... F15B 15/28
DE 102010060550 A1 5/2012
(Continued)

OTHER PUBLICATIONS

Translation of DE-102010060550-A1 (provided by Applicant) (Year: 2012).*
(Continued)

*Primary Examiner* — Nathaniel T Woodward
(74) *Attorney, Agent, or Firm* — Taft Stettinius & Hollister LLP; Stephen F. Rost

(57) ABSTRACT

A work vehicle includes a work implement operatively connected to a frame through an actuator having a cylinder and a piston rod. Control circuitry is operatively connected to the actuator and includes a processer and a memory, wherein the memory is configured to store program instructions and the processor is configured to execute the stored program instructions to: identify one of an initial retracted reference position of the piston rod based on an initial minimum retracted distance or an initial extended reference position of the piston rod based on an initial maximum extended distance; identifying an end of stroke position of the piston rod after identifying one of the initial retracted reference position of the piston rod or the initial extended reference position of the piston rod; and moving the work implement with respect to the work vehicle based on a work implement command modified by the identified end of stroke position.

20 Claims, 9 Drawing Sheets

(51) Int. Cl.

| | |
|---|---|
| ***E02F 9/26*** | (2006.01) |
| ***E02F 9/20*** | (2006.01) |
| ***E02F 3/76*** | (2006.01) |
| ***E02F 9/24*** | (2006.01) |

(52) U.S. Cl.
CPC ..... *E02F 9/2041* (2013.01); *E02F 9/2271* (2013.01); *E02F 9/24* (2013.01); *E02F 9/26* (2013.01); *E02F 3/7609* (2013.01)

(58) Field of Classification Search
USPC ..... 73/7
See application file for complete search history.

(56) References Cited

U.S. PATENT DOCUMENTS 7,120,523 B2 * 10/2006 Muller ..... G07C 3/00 701/33.9
8,100,045 B2 * 1/2012 Osborn ..... F15B 15/2815 91/1
9,459,609 B2 * 10/2016 Koizumi ..... G05B 23/0283

FOREIGN PATENT DOCUMENTS

DE 102016200924 A1 7/2017
EP 3505774 A1 7/2019

OTHER PUBLICATIONS

"Method for Calibrating Implement Control Valve Maximum Drive Current," Defensive Publication, IP.com, IP.com No. IPCOM000258419D, publication date May 9, 2019, 3 pages.
"Attachment Calibration Control System," U.S. Appl. No. 16/176,165, publication date TBD, 34 pages, filed by Deere & Company.
German Search Report issued in counterpart application No. 102020200135.9 dated Oct. 27, 2020 (14 pages).

* cited by examiner

GRADE CONTROL HAVING REAL TIME CYLINDER STOP LENGTHS

CROSS-REFERENCE TO RELATED APPLICATION

This application is a continuation-in-part application of U.S. patent application Ser. No. 16/242,681, filed Jan. 8, 2019, having the title "System and Method to Determine Mechanical Wear in a Machine Having Actuators", which is hereby incorporated by reference in its entirety.

FIELD OF THE DISCLOSURE

The present disclosure relates to a work vehicle having an adjustable work implement, and in particular a work vehicle having a work implement moved by one or more actuators.

BACKGROUND

Work vehicles are configured to perform a wide variety of tasks including use as construction vehicles, forestry vehicles, lawn maintenance vehicles, as well as on-road vehicles such as those used to plow snow, spread salt, or vehicles with towing capability. Additionally, work vehicles typically perform work with one or more work implements that are moved by actuators in response to commands provided by a user of the work vehicle, or by commands that are generated automatically by a control system, either located within the vehicle or located externally to the vehicle. Other work vehicles include, but are not limited to, excavators, loaders, and motor graders.

A work vehicle, such as a motor grader, can be used in construction and maintenance for creating a flat surface having various angles, slopes, and elevations. When paving a road for instance, a motor grader can be used to prepare a base foundation to create a wide flat surface to support a layer of asphalt. A motor grader can include two or more axles, with an engine and cab disposed above the axles at the rear end of the vehicle and another axle disposed at the front end of the vehicle.

Motor graders include an implement positioner, that can including linkages, to position a drawbar assembly attached near the nose of the grader which is pulled by the grader as it moves forward. The drawbar assembly rotatably supports a circle drive member at a free end of the drawbar assembly and the circle drive member supports a work implement, such as the blade. The blade, also called a mouldboard, is attached to the vehicle between the front axle and rear axle. The angle of the blade beneath the drawbar assembly can be adjusted by the rotation of the circle drive member relative to the drawbar assembly.

In addition to the blade being rotated about a rotational fixed axis, the blade is also adjustable to a selected angle with respect to the circle drive member. This angle is known as blade slope. The elevation of the blade is also adjustable.

Work vehicles include one or more actuators incorporated into the implement positioner and coupled to the work implement either directly or indirectly through the actuator. In many instances, the actuator includes a hydraulic actuator, also known as a hydraulic cylinder. Motor driven actuators are also known. The hydraulic cylinder includes a housing coupled to a first part of vehicle, such as a frame, and a rod coupled to the implement, either directly or indirectly through an arm or other part of the work vehicle.

In one or more work vehicles, a machine control system is used to adjust the position of the work implement based on a location of the work vehicle. Machine control systems, which include two dimensional (2D) and three dimensional (3D) machine control systems, can be located at or near the surface being graded to provide grade information to the motor grader. A vehicle grade control system receives signals from the machine control system to enable the motor grader to grade the surface. The motor grader includes a grade control system operatively coupled to each of the sensors, so that the surface being graded can be graded to the desired slope, angle, and elevation. The desired grade of the surface is planned ahead of or during a grading operation.

Machine control systems can provide slope, angle, and elevation signals to the vehicle grade control system to enable the motor grader or an operator to adjust the slope, angle, and elevation of the work implement. The vehicle grade control system can be configured to automatically control the slope, angle, and elevation of the blade to grade the surface based on desired slopes, angles, and elevations as is known by those skilled in the art. In these automatic systems, adjustments to the position of the work implement with respect to the vehicle are made constantly in order to achieve the slope, angle and/or elevation targets.

The position of the work implement with respect to the surface can be affected by various operating conditions of the work vehicle such as the mechanical conditions of the implement positioner, the linkage, and the actuator. Many different parts of the work vehicle experience wear, including the hydraulic cylinder. For instance, the cylinder arm typically includes an aperture coupled to another part, located on the work vehicle, by a connector such as a pin. Continued use of the implement over a period of time can and often does cause mechanical wear to occur at the aperture due to the repetitive motion. In other cases, the wear can occur at the part to which the cylinder arm or the housing is connected. If the wear becomes too great, the motion of the implement is affected such that the directed movement is less precise than desired. What is needed therefore is a system and method to determine mechanical wear in a work machine having actuators.

SUMMARY

In one embodiment of the present disclosure, there is provided a method of moving a work implement coupled to a hydraulic actuator having a cylinder and a piston rod wherein the hydraulic actuator is coupled to the work implement and coupled to a part of a work vehicle. The method includes: identifying, with a sensor, one of: i) an initial retracted reference position of the piston rod based on an initial minimum retracted distance or ii) an initial extended reference position of the piston rod based on an initial maximum extended distance; identifying, with the sensor, an end of stroke position of the piston rod after identifying one of the initial retracted reference position of the piston rod or the initial extended reference position of the piston rod; and moving the work implement with respect to the work vehicle based on a work implement command modified by the identified end of stroke position.

In another embodiment of the present disclosure, there is provided a work vehicle including a work implement operatively connected to a frame including an actuator operatively connected to the work implement, wherein the actuator includes a cylinder and a piston rod and the actuator is configured to move the work implement with respect to the frame. The work vehicle further includes control circuitry operatively connected to the actuator, wherein the control circuitry includes a processer and a memory. The memory is configured to store program instructions and the processor is configured to execute the stored program instructions to: identify, with a sensor, an initial reference position of the piston rod based on an initial minimum retracted distance or an initial maximum extended reference position of the piston rod based on an initial maximum extended distance; identify, with the sensor, an end of stroke position of the piston rod after identifying one of the initial retracted reference position of the piston rod or the initial extended reference position of the piston rod; and move the work implement with respect to the work vehicle based on a work implement command modified by the identified end of stroke position.

In a further embodiment of the present disclosure, there is provided a grade control system for a work vehicle including a frame and a grader blade operatively connected to the frame and configured to move through a range of positions to grade a surface. The control system includes an actuator configured to move the grader blade with respect to the frame and is operatively connected to the grader blade. The actuator includes a cylinder, a piston rod, and a sensor to determine a position of the piston rod with respect to the cylinder. Control circuitry is operatively connected to the actuator and includes a processer and a memory. The memory is configured to store program instructions and the processor is configured to execute the stored program instructions to: identify, with the sensor, one of: i) an initial retracted reference position of the piston rod based on an initial minimum retracted distance; or ii) an initial extended reference position of the piston rod based on an initial maximum extended distance; identify, with the sensor, an end of stroke position of the piston rod after identifying one of the initial retracted reference position of the piston rod or the initial extended reference position of the piston rod; identify a first position of the grader blade with respect to the surface; and move the grader blade from the identified first position to a second position, wherein the second position is based on a blade command modified by the identified end of stroke position.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

Corresponding reference numerals are used to indicate corresponding parts throughout the several views.

DETAILED DESCRIPTION

The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure.

Figure 1:
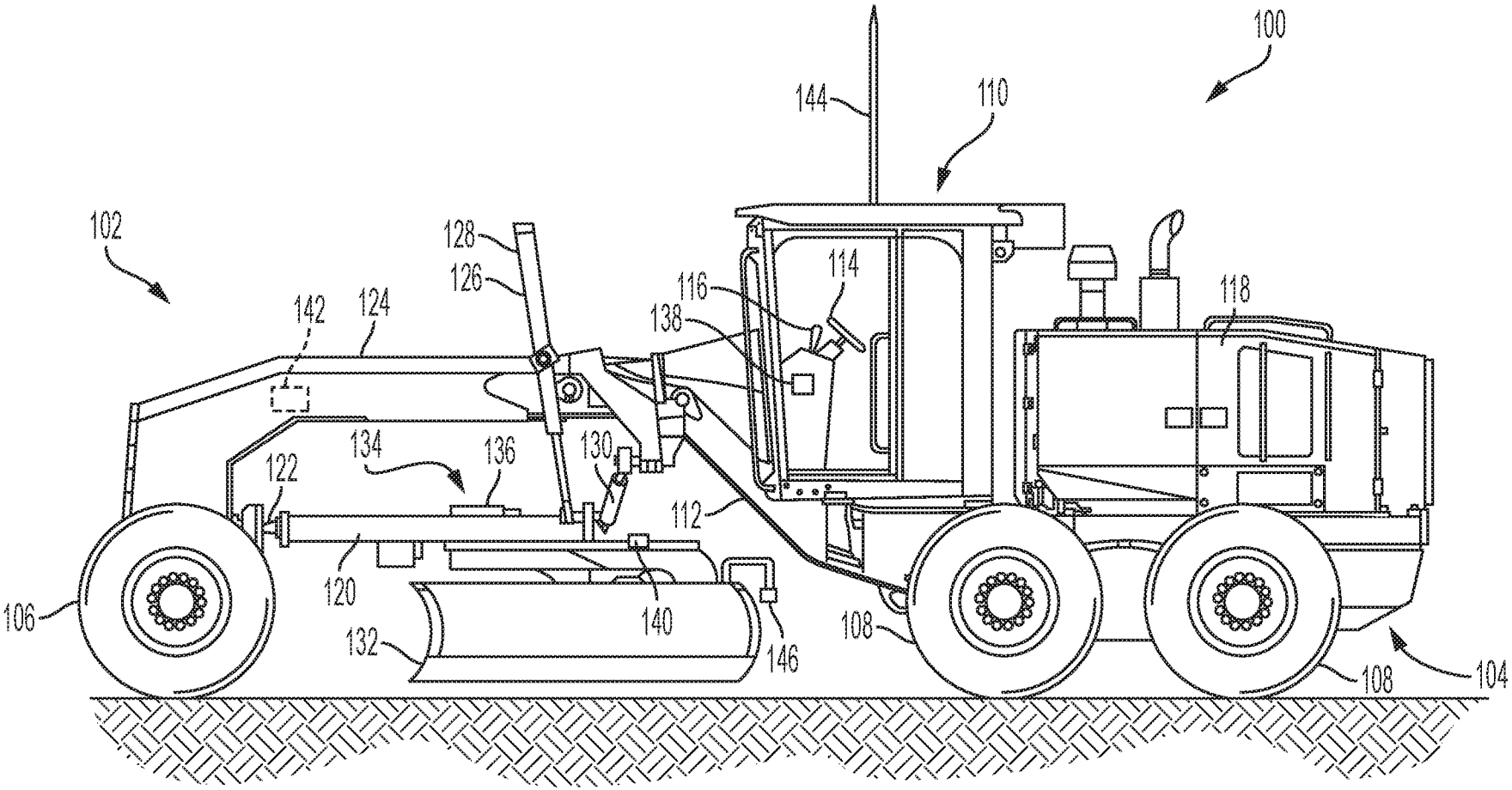
FIG. 1 is an elevational side view of a motor grader.

Referring to FIG. 1, an exemplary embodiment of a vehicle, such as a motor grader 100, is shown. An example of a motor grader is the 772G Motor Grader manufactured and sold by Deere & Company. As shown in FIG. 1, the motor grader 100 includes front frame 102 and rear frame 104, with the front frame 102 being supported on a pair of front wheels 106, and with the rear frame 104 being supported on right and left tandem sets of rear wheels 108. An operator cab 110 is mounted on an upwardly and forwardly inclined rear region 112 of the front frame 102 and contains various controls for the motor grader 100 disposed so as to be within the reach of a seated or standing operator. In one aspect, these controls may include a steering wheel 114 and a lever assembly 116. An engine 118 is mounted on the rear frame 104 and supplies power for all driven components of the motor grader 100. The engine 118, for example, is configured to drive a transmission (not shown), which is coupled to drive the rear wheels 108 at various selected speeds and either in forward or reverse modes. A hydrostatic front wheel assist transmission (not shown), in different embodiments, is selectively engaged to power the front wheels 106, in a manner known in the art. In one embodiment, the wheels 106 and 108 are pneumatic tires supported by rims as is known by those skilled in the art.

Mounted to a front location of the front frame 102 is a drawbar or draft frame 120, having a forward end universally connected to the front frame 102 by a ball and socket arrangement 122 and having opposite right and left rear regions suspended from an elevated central section 124 of the front frame 102. Right and left lift linkage arrangements including right and left extensible and retractable hydraulic actuators 126 and 128, respectively, support the left and right regions of the drawbar 120. The right and left lift linkage arrangements 126 and 128 either raise or lower the drawbar 120. A side shift linkage arrangement is coupled between the elevated frame section 124 and a rear location of the drawbar 120 and includes an extensible and retractable side swing hydraulic actuator 130. A work implement 132 is coupled to the front frame 102 and powered by a circle drive assembly 134. In different embodiment, the work implement 132 includes a blade or a mouldboard.

The drawbar 120 is raised or lowered by the right and left lift linkage arrangements 126 and 128 which in turn raises or lowers the blade 132 with respect to the surface. The actuator 130 raises or lowers one end of the blade 132 to adjust the slope of the blade to move material, such as soil or aggregate, to a grade a work site. In other embodiments, the angle of the blade 132 is adjusted by actuating mechanisms configured to move the blade 132 in response to a control signal provided by an operator or in response to a control signal provided by a machine control system including sonic systems, laser systems, and global positioning systems (GPS).

The circle drive assembly 134 includes a rotation sensor 136, which in different embodiments, includes one or more switches that detect movement, speed, or position of the blade 132 with respect to the vehicle front frame 102. The rotation sensor 136 is electrically coupled to a controller 138, which in one embodiment is located in the cab 110. In other embodiments, the controller 138 is located in the front frame 102, the rear frame 104, or within an engine compartment housing the engine 118. In still other embodiments, the controller 138 is a distributed controller having separate individual controllers distributed at different locations on the vehicle. In addition, while the controller is generally hardwired by electrical wiring or cabling to sensors and other related components, in other embodiments the controller includes a wireless transmitter and/or receiver to communicate with a controlled or sensing component or device which either provides information to the controller or transmits controller information to controlled devices.

A slope sensor 140 is configured to detect the slope of the blade 132 and to provide slope information to the controller 138. In different embodiments, the slope sensor 140 is coupled to a support frame for the blade 132 of the hydraulic actuator 130 to provide the slope information. A mainfall sensor 142 is configured to detect the grading angle of the vehicle 100 with respect to gravity and to provide grading angle information to the controller 138. For instance, the mainfall sensor 142 measures the upward angle of the vehicle 100 as it moves up a hill.

An antenna 144 is located at a top portion of the cab 110 and is configured to receive signals from different types of machine control systems including sonic systems, laser systems, and global positioning systems (GPS). While the antenna 144 is illustrated, other locations of the antenna 144 are included as is known by those skilled in the art. For instance, when the vehicle 100 is using a sonic system, a sonic tracker 146 is used detect reflected sound waves transmitted by the sonic system through with the sonic tracker 146. In a vehicle 100 using a laser system, a mast (not shown) located on the blade supports a laser tracker located at a distance above the blade 132. In one embodiment, the mast includes a length to support a laser tracker at a height similar to the height of a roof of the cab. A GPS system includes a GPS tracker located on a mast similar to that provided for the laser tracker system. Consequently, the present disclosure applies vehicle motor grader systems using both relatively "simple" 2D cross slope systems and to "high end" 3D grade control systems.

Figure 2:
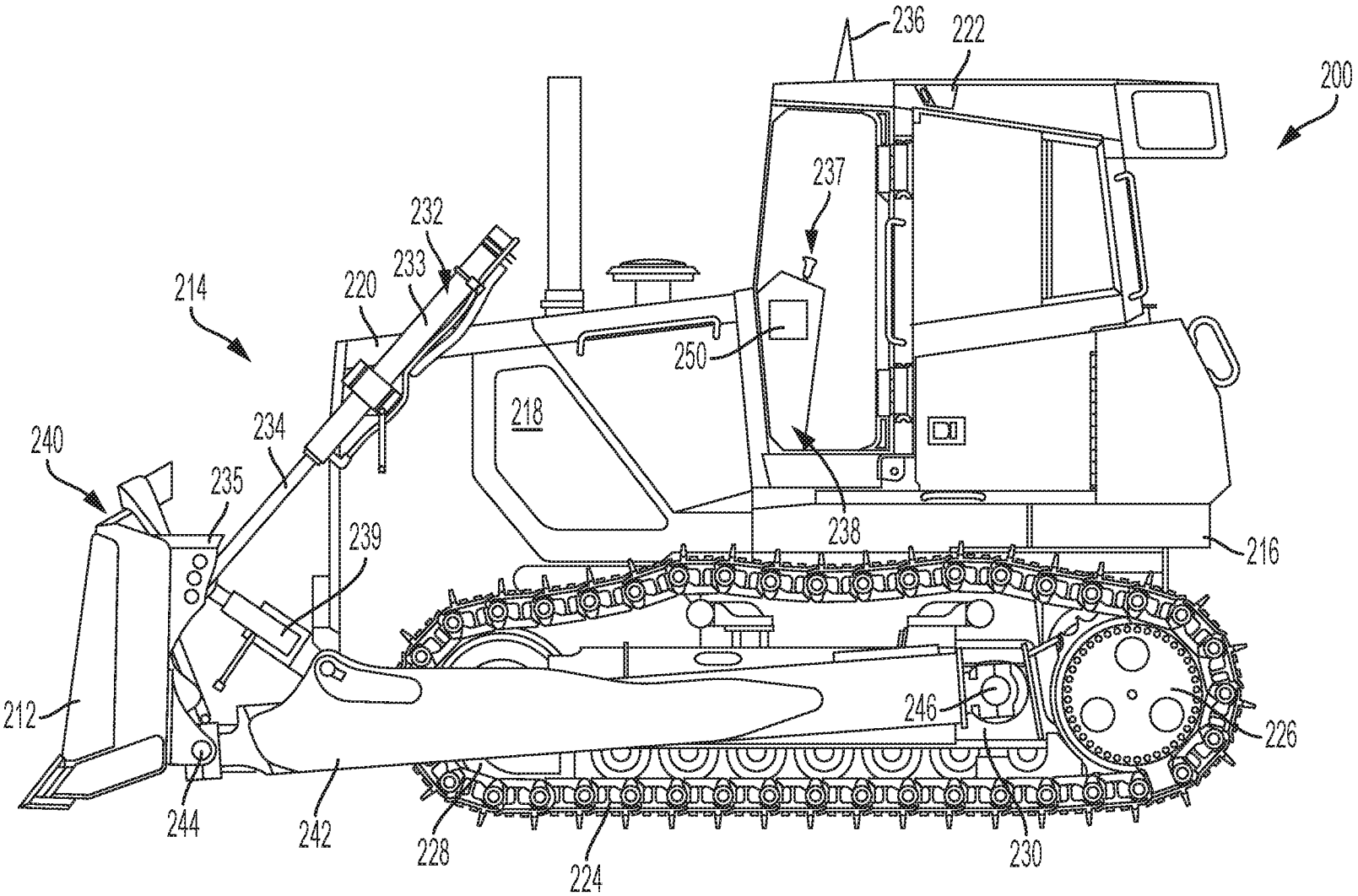
FIG. 2 is an elevational side view of a bulldozer, such as a crawler dozer including a blade.

FIG. 2 is an elevational side view of another work vehicle 200, a crawler bulldozer, including an implement, such as a bulldozer blade 212, which is suitably coupled to the dozer by a linkage assembly 214. The vehicle includes a frame 216 which houses an internal combustion engine 218 located within a housing 220. The work vehicle 200 includes a cab 222 where an operator sits or stands to operate the vehicle. The vehicle is driven by a belted track 224 which operatively engages a rear main drive wheel 226 and a front auxiliary drive wheel 228. The belted track is tensioned by tension and recoil assembly 230. The belted track is provided with centering guide lugs for guiding the track across the drive wheels, and grousers for frictionally engaging the ground.

The main drive wheels 226 are operatively coupled to a steering system which is in turn coupled to a transmission. The transmission is operatively coupled to the output of the internal combustion engine 218. The steering system may be of any conventional design and maybe a clutch/brake system, hydrostatic, or differential steer. The transmission may be a power shift transmission having various clutches and brakes that are actuated in response to the operator positioning a shift control lever (not shown) located in the cab 222.

The bulldozer blade 212 (the implement) is raised and lowered by actuators 232, such as hydraulic cylinders, to move material at a work site. While one actuator 232 is shown in FIG. 2, two actuators 232 are operatively connected to the blade 212 as is understood by one skilled in the art. Each of the actuators 232 includes a hydraulic actuator including a body 233, or cylinder, and an arm 234 that extends and retracts from the cylinder. The cylinder 233 is rotatably coupled to the frame 216 or housing 220 and the arm 234 is rotatably coupled to a plate 235 fixedly coupled to the blade 212. While a plate is described, other parts to connect the arm 234 to the blade 212 are contemplated including brackets, studs, pillars, lugs, rims, collars, and ribs.

One or more implement control devices 237, located at a user interface of a workstation 238, are accessible to the operator located in the cab 222. The blade 212 is tilted by actuators 239, such as hydraulic actuators or hydraulic cylinders, which adjust a tilt angle of the blade 212 moving an upper portion 240 of the blade 212 toward or away from the frame 216. Additional actuators, such as hydraulic cylinders, move the blade 212 left or right of a center longitudinal axis of the vehicle 210. The extension and retraction of the hydraulic cylinders is controlled by the operator through the control devices 237.

The implement control devices 237 are located at a user interface that includes a plurality of operator selectable buttons configured to enable the operator to control the operations and functions of the vehicle 200. The user interface, in one embodiment, includes a user interface device including a display screen having a plurality of user selectable buttons to select from a plurality of commands or menus, each of which are selectable through a touch screen having a display. In another embodiment, the user interface includes a plurality of mechanical push buttons as well as a touch screen. In still another embodiment, the user interface includes a display screen and only mechanical push buttons. In one or more embodiments, adjustment of the blade with respect to the frame is made using one or more levers or joysticks.

Figure 3:
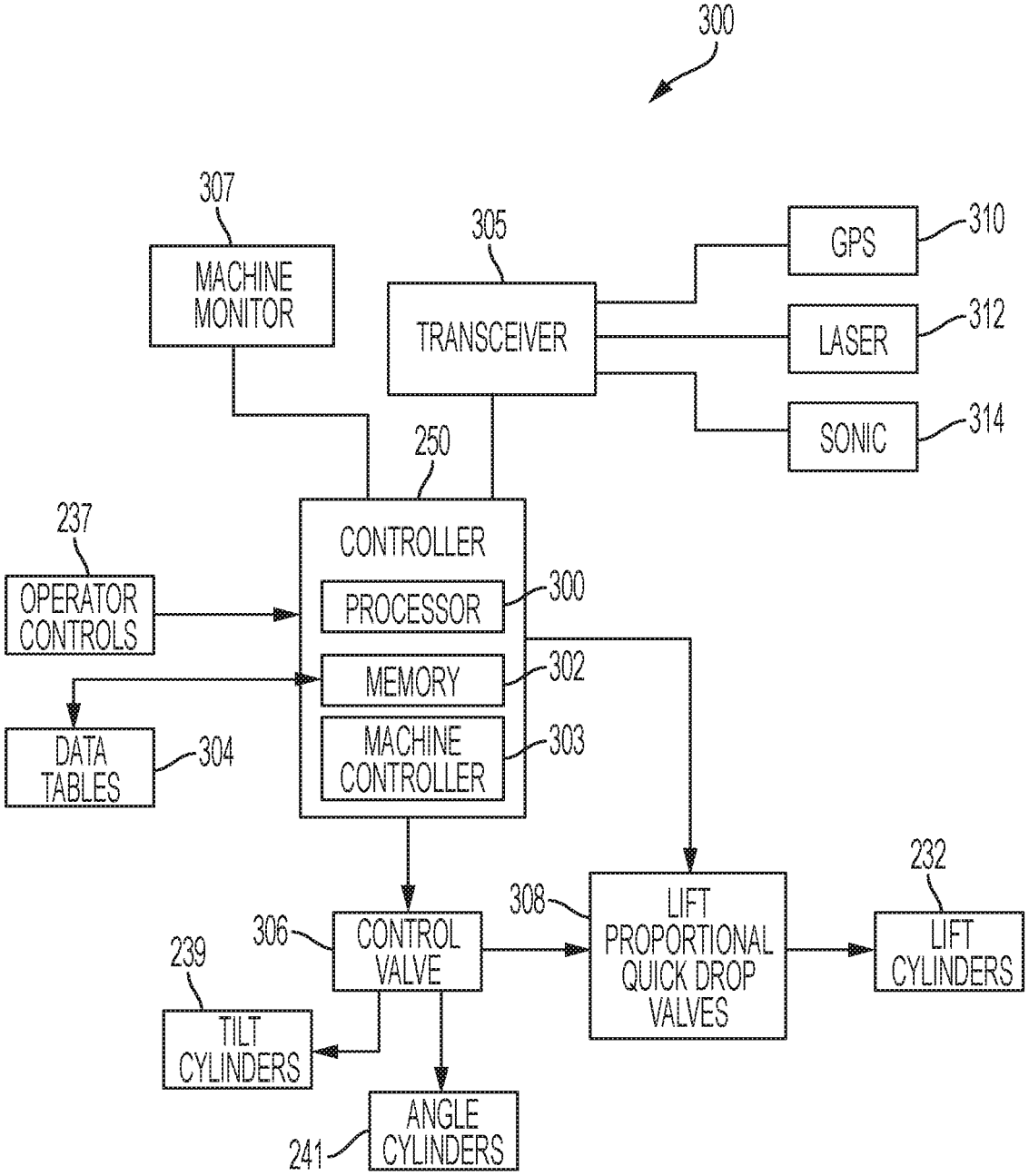
FIG. 3 is a schematic block diagram of a control system configured to control the position of an implement and to determine mechanical wear resulting from repeated movement of an implement of a work vehicle.

Extension and retraction of the actuators 232 raises or lowers the blade 212 with respect to ground or another surface upon which the vehicle 200 is located. The blade 212 is rotatably coupled to a push arm 242 at a rotational axis 244 at one end of the push arm. The push arm 242 is rotatably coupled to the frame 216 at a rotational axis 246. Extension or retraction of the actuators 232 moves the blade 212 up or down as the push arm 242 rotates about the rotational axis 246. Adjustment of the actuators is made by the operator using the controls 237 which are operably coupled to a controller 250, as seen in FIG. 3, which in one embodiment, is located at the workstation 238. In other embodiments, the controller 250 is located at other locations of the work vehicle. As can be seen in FIG. 3, the operator control devices 237 are operatively connected to the controller 250 which is operatively to the tilt cylinders 239, angle cylinders 241, and to the lift cylinders 232.

In FIG. 1, the antenna 144 is located at a top portion of the cab 110, and in FIG. 2 the antenna 236 is located a top portion of the cab 222. In each of the work vehicles 100 and 200 of FIGS. 1 and 2, the antenna is configured to receive and to transmit signals from different types of machine control systems and or machine information systems including a global positioning systems (GPS). While the antennas are illustrated at a top portion of the cabs, other locations of the antennas are contemplated as is known by those skilled in the art.

As described above, the mechanical actuator is used in a wide variety of work machines and consequently other types of work machines having mechanical actuators are contemplated. The actuators in work vehicles of those described in FIGS. 1 and 2 and other work vehicles, experience continual use over extended periods of time and consequently, the actuator, and the parts of the work machine to which the actuator is coupled, experience wear. If this wear is not identified sufficiently early, the unrecognized wear reduces the effectiveness of the movement of the implement. If use continues, the wear becomes excessive and results in damage to one or more of the actuator, the implement, or machine parts coupled to the actuator. Actuators used in one or more of these work vehicles includes tilt, angle, lift, arm, boom, bucket, blade side shift, blade tilt, and saddle side shift actuators or actuator cylinders.

The present disclosure is not limited to systems and methods including mechanical actuators that are configured to move implements, but other systems and methods including mechanical actuators configured to move one part of a work vehicle with respect to another part of a work vehicle are also contemplated. Other types of work vehicles having mechanical actuators are therefore contemplated including, but not limited to excavators and motor graders.

FIG. 3 illustrates a control system 300 for the work vehicle 200 of FIG. 2. While the control system 300 for the work vehicle 200 is shown, the elements and functions of the control system 300 are equally applicable to the work vehicle 100 of FIG. 1 and its controller 138, and other work vehicles. For instance the vehicle 100 includes actuators 126, 128, and 130 that provide functions particular to a motor grader. The vehicle 200 includes actuators 232 and 239 particular to crawler bulldozer.

Adjustment of the actuators of work vehicle 200 is made by the operator using the controls 237 which are operably coupled to a controller 250, as seen in FIG. 3, which in one embodiment, is located at the workstation 238. In other embodiments, the controller 250 is located at other locations of the work vehicle. As can be seen in FIG. 3, the operator control devices 237 are operatively connected to the controller 250 which is operatively to the tilt actuators 239, angle actuators 241, and to the lift actuators 232. Other actuators performing other functions are contemplated.

As seen in FIG. 3, the controller 250, in one or more embodiments, includes a processor 300 operatively connected to a memory 302. In still other embodiments, the controller 250 is a distributed controller having separate individual controllers distributed at different locations on the vehicles 100 or 200. In addition, while the controller is generally hardwired by electrical wiring or cabling to related components, in other embodiments the controller 250 includes a wireless transmitter and/or receiver to communicate with a controlled or sensing component or device which either provides information to the controller or transmits controller information to controlled devices.

The controller 250, in different embodiments, includes a computer, computer system, or other programmable devices. In other embodiments, the controller 250 includes one or more processors 300 (e.g. microprocessors), and the associated memory 302, which can be internal to the processor or external to the processor. The memory 302 includes, in one or more embodiments, random access memory (RAM) devices comprising the memory storage of the controller 250, as well as any other types of memory, e.g., cache memories, non-volatile or backup memories, programmable memories, or flash memories, and read-only memories. In addition, the memory can include a memory storage physically located elsewhere from the processing devices and can include any cache memory in a processing device, as well as any storage capacity used as a virtual memory, e.g., as stored on a mass storage device or another computer coupled to controller 250. The mass storage device can include a cache or other dataspace which can include databases. Memory storage, in other embodiments, is located in the "cloud", where the memory is located at a distant location which provides the stored information wirelessly to the controller 250.

The controller 250 executes or otherwise relies upon computer software applications, components, programs, objects, modules, or data structures, etc. Software routines resident in the included memory of the controller 250 or other memory are executed in response to the signals received. The computer software applications, in other embodiments, are located in the cloud. The executed software includes one or more specific applications, components, programs, objects, modules or sequences of instructions typically referred to as "program code". The program code includes one or more instructions located in memory and other storage devices that execute the instructions resident in memory, which are responsive to other instructions generated by the system, or which are provided at a user interface operated by the user. The processor 300 is configured to execute the stored program instructions as well as to access data stored in one or more data tables 304. A transceiver 305, or a transmitter and/or receiver, is operatively connected to the antenna 236. The transceiver 305 is configured to transmit and to receive wireless signals at the antenna 236. A machine monitor 307 is operatively connected to the controller 250 and is configured to monitor the positions of various movable parts of the vehicle with respect to other parts, such as the blade 212 with respect to the frame 216.

The height of the blade 212 is adjusted by the extension and retraction of linear hydraulic actuators 232 which respond to movement of the operator control 237, such as a joystick. The joystick generates a command signal that is received by the controller 250, which determines the commanded position of the blade and generates a lift control command signal transmitted to an actuator lift control valve 306 and a proportional quick drop command signal transmitted to lift proportional quick drop valves 308. Each of the lift cylinders 233 is operatively connected to one of the actuator control valves 306 and to the lift proportional quick drop valve 308.

In other embodiments of work vehicles in which the position of the work implement is adjusted by an external system, the transceiver 305 is operatively connected to one or more of a GPS system 310, a laser system 312, and a sonic system 314. In each of these systems, the position of some or all of the actuators are controlled in part or completely by one or more of the GPS system 310, the laser system 312, and the sonic system 314.

In one or more embodiments, the transceiver 305 receives slope, angle, and/or elevation signals generated by one or more types of machine control systems including the GPS system 310, the laser system 312, and the sonic system 314.

In the work vehicle 100, these signals are collectively identified as contour instructions or contour signals. Each of the machine control systems 310, 312, and 314 communicates with the controller 250 through the transceiver 305 which is operatively connected to the appropriate type of antenna, such as antennas 144 or 236, as is understood by those skilled in the art. A machine controller 303, in one or more embodiments, is embodied in the controller 250 and is configured to adjust the position of the implement using the described actuators in combination with the machine monitor 307. In other embodiments, the machine controller is embodied in other controllers separate from the controller 250. The controller 250 transmits signals to each of the actuators to adjust the position of the implement through a communication network of the vehicle. In one or more embodiments, the vehicle's communication network includes one or more of a CAN network, an Ethernet network, a WIFI network, a Bluetooth network, a GPS network, a cellular network, and a satellite network. Other types of communication networks are contemplated.

In one embodiment, the controller 250 provides engine control instructions to an engine control unit (not shown) and transmission control unit instruction to the transmission control unit (not shown) to adjust the speed of the vehicle in response to grade information provided by one of the machine control systems including the GPS system 310, the Laser 312, and the sonic system 314. In other embodiments, other machine control systems are used.

Figure 4:
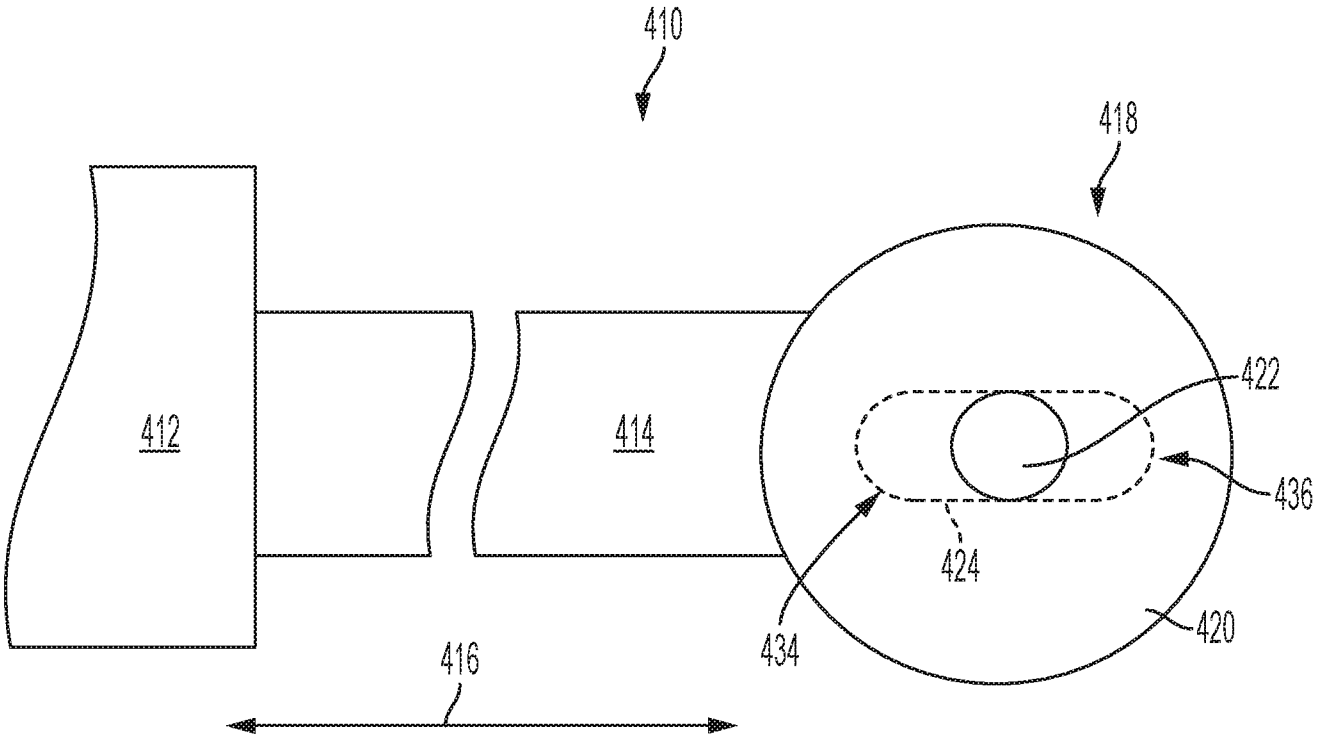
FIG. 4 is a representational view of mechanical wear experienced by an actuator.

Over a period of time as the actuators continually adjust the location of one part with respect to another part, the actuator suffers wear. For instance as seen in FIG. 4, an actuator 410 includes an actuator body 412 and an actuator rod 414 that extends from and retracts into the actuator body 412 along a line 416. The actuator rod 414 includes an end 418 having a coupler 420 with an aperture 422. The coupler 420 is generally circular and is configured to be attached to a part to be moved, such as the blade 212, with a pin or other connecting device not shown. As the rod 414 continues to move along the line 416, either extending or retracting, the aperture 422 deforms along an expanded aperture 424 due to the forces applied as illustrated by the dotted outline. Over a period of time consequently the aperture 422 becomes larger. As the aperture becomes larger, the location of the part being moved by the rod 414 becomes less precise due to the fit between the end of the rod 414 and the aperture 422 becoming loose. In some cases, a gap appears between parts and the end of the rod 414 moves within the aperture. Over a period of time, the operator using the operator control 237 cannot accurately position the attached part, such as the blade 212, to a desired location due to the gap and consequently, the operations being performed either take longer or do not achieve the desired outcome. Not only is the operator or the machine controller 303 not able to accurately adjust the position of the blade, the operations performed by the implement do not accurately reflect the control instructions received from the operator control 237 or the machine controller 303.

While the aperture 422 is shown as expanding to the dotted outline 424, the dotted outline is representational and the distortion of the aperture 422 takes many different forms. In addition, the part to which the coupler 422 is attached may also experience a distortion. Likewise, because the actuator body 412 is coupled to another location on the machine, the end of the actuator body 412, or the part to which the actuator body is coupled, may experience distortion. In any event, the resulting distortion, no matter where located, is an undesirable result of the continual operation of the actuator and requires either repair or replacement of the actuator, parts of the actuator, or parts of the machine to which the actuator is coupled.

Figure 5:
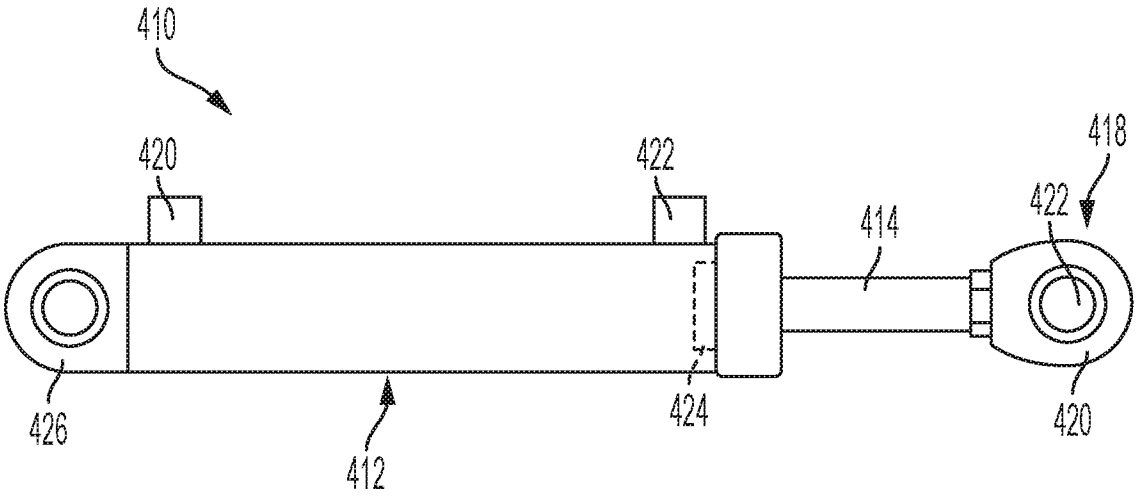
FIG. 5 is an elevational view of an arm completely extended from an actuator body.

In different embodiments, one or more of the actuators are configured to include sensors to detect the location of the rod 414 with respect to the body 412. As seen in FIG. 5, the cylinder 410 includes a first sensor 420 and a second sensor 422 to sense a location of a sensed element 424 which is operatively connected to the rod 414. In the illustrated embodiment, the first sensor 420 determines the location of the sensed element 424 when the rod 414 is retracted into the actuator body 412 toward the end of a actuator body coupler 426. The second sensor 422 determines the location of the sensed element 424 when the arm is extended from the actuator body 412 toward and end 428. Each of the first and second sensors 420 and 422 is coupled to or is incorporated into the machine monitor 307 and is configured to determine the location of the sensed element with respect to the actuator body 412.

In one or more embodiments, the actuators include but are not limited to sensors located on, near, or within the actuator body 412. In different embodiments, a sensor system including both the sensor and the sensed element 424 include: a rod that trips a micro-switch or a pneumatic valve; a pressure threshold sensor that responds to a drop in exhaust pressure once the rod stops moving; a magnetic sensor mounted directly to the actuator body to sense a magnetic field of a magnet acting as the sensed element that is coupled to the rod; one or more reed switches triggered by the rod; a Hall effect sensor triggered by a magnetic sensed element; a pneumatic reed valve triggered by a magnetic sensed element; a photoelectric element; an inductive element; or a capacitive element. Other types of sensor systems are contemplated.

In known actuators, the maximum extension of the rod from the cylinder body determines the maximum position of the part being moved by the rod with respect to the other part of the machine to which the cylinder is attached. The minimum extension of the rod from the cylinder body determines the minimum position of the part being moved. Consequently, if two machine parts are separated by a maximum distance of 10 inches, for instance, the distance traveled by the rod from its retracted position to its extended position is 10 inches. It is the actuator that determines the a maximum distance of extension to identify an extended reference location and a minimum distance of extension to identify an retracted reference location.

In one or more embodiments of the present invention, however, an actuator is selected having a distance between a minimum extension and a maximum extension of greater than a minimum distance and maximum distance of the part being moved. For instance using the above example of 10 inches of movement, a cylinder having 12 inches of movement between the minimum distance and the maximum distance is employed and the part or parts being moved include mechanical stops incorporated into the parts themselves that limit movement of the rod to 10 inches. Consequently, the maximum distance and the minimum distance of parts of the disclosed work machines are fixed by the machine parts and not the actuator. The machine parts determine the end of stroke in either the fully extended or fully retracted position of the piston rod.

Figure 6:
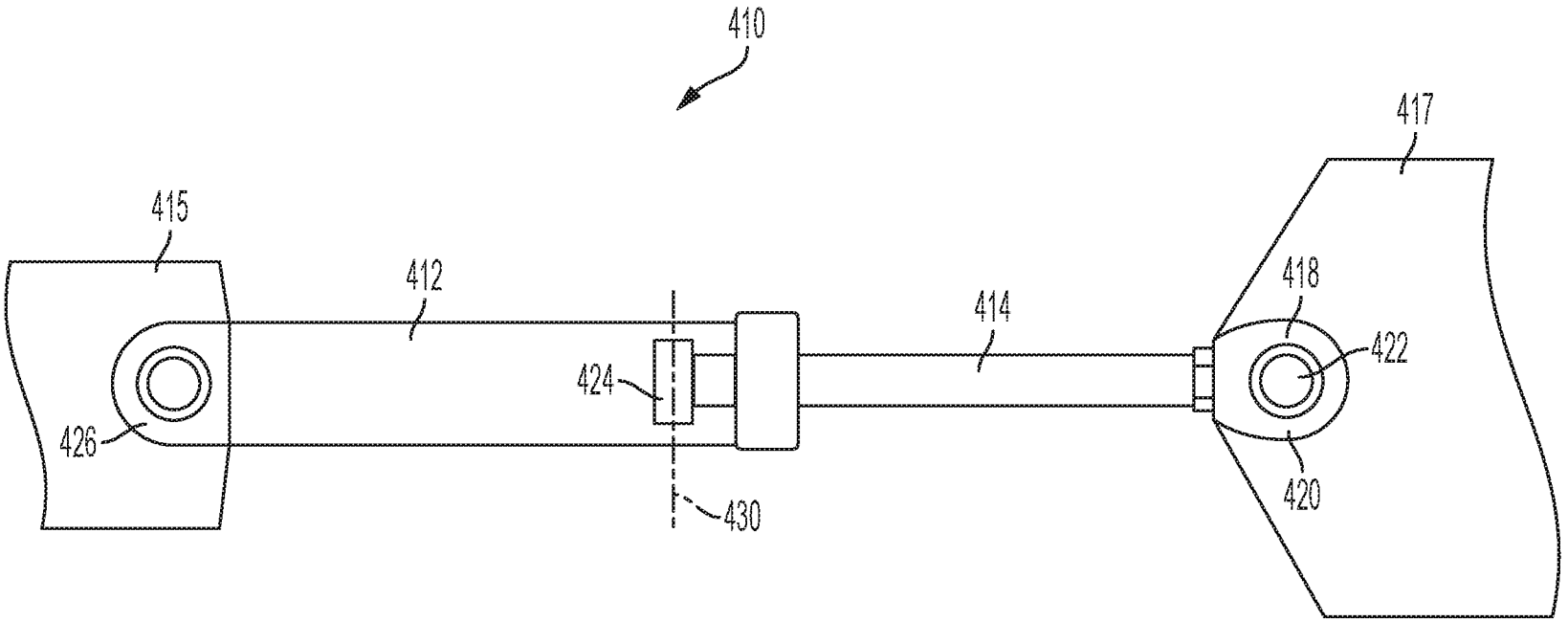
FIG. 6 is an elevational view of an arm extended from an actuator body at a distance of less than a complete extension.

As seen in FIG. 6 for a new machine build, the maximum extension of the rod 414 is fixed by parts 415 and 417 of the machine and consequently the machine limits the maximum extension of the rod 414. At the maximum extension is a maximum location of the rod before wear has occurred. As illustrated in FIG. 6, for example, the arm 414 is extended to a percentage of full extension, which in this case is 95% at line 430. While the arm is extended to a percentage of full extension, the distance between machine parts is 100% as determined by the machine and/or its parts.

Figure 7:
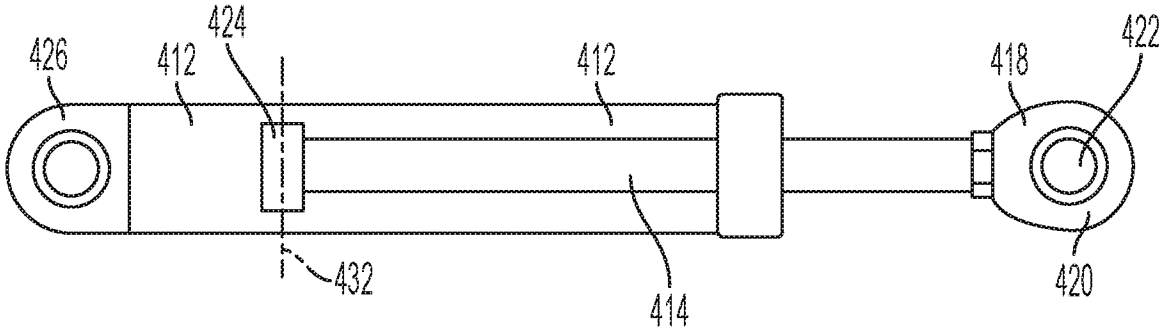
FIG. 7 is an elevational view of an arm retracted into an actuator body at a distance of less than a complete retraction.

When the machine parts are moved to their closest position for a new machine, the rod 414 is not fully retracted as illustrated in FIG. 7, wherein movement of the rod is limited by the machine itself. In this position, the end 424 is located at a percentage of full extension, which in this example is 5% at line 432.

As the aperture 422 deforms along the outline of expanded aperture 424, as illustrated in FIG. 4, the expanded aperture 424 permits the rod 414 to move further in either direction along the line 416. When the rod 414 moves to full extension, for instance, the rod 414 has more room to move toward an end 434 of the aperture 424 that permits a greater extension of the rod 414 from the body 412. With this movement, the sensed element 424 is located at a position between 95% and 100% of rod extension. Because the location of the sensed element 424 has changed, wear at the aperture 422 is identified. Likewise, when the rod 414 moves to full retraction, the aperture 424 permits a greater retraction of the rod toward an end 436. With this movement, the sensed element 424 is located at a position of between 0% and 5% in this example. The sensors 420 and 422 therefore identify wear due to the changing location of the sensed element over a period of use.

Figure 8:
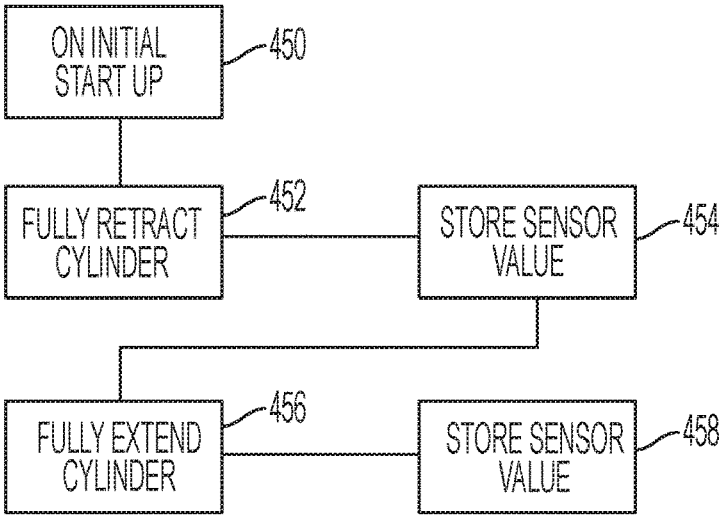
FIG. 8 is a process diagram to determine a location of an actuator arm at initial startup.

As described above, each of the first and second sensors 420 and 422 is coupled to, or is incorporated into, the machine monitor 307 and configured to determine the location of the sensed element 424 with respect to the actuator body 412. The location information provided by each of the sensors 420 and 422 is used in a process diagram of FIG. 8.

When a new vehicle is put into operation or a used vehicle has been repaired or modified to correct an issue of wear, the process begins at block 450, i.e. on initial startup. When the vehicle has been started, the arm 414 of the cylinder is fully retracted at block 452. The location of the sensed element 424 is identified by the sensor 420 and stored at block 454 in the data table 304 of FIG. 3. This stored value is identified as a minimum initial value. The arm 414 of the cylinder 410 is also fully extended at block 456 and the location of the sensed element 424 is identified by the sensor 422 and stored at block 458 in the data table 304. This stored value is identified as a maximum initial startup value. The order of the identification of the minimum value and the maximum value of the location of the sensed element 424 at full extension and full retraction is not determinative. Full retraction and full extension at the initial startup are based on the parts of the vehicle to which the actuator is coupled. Full retraction and full extension based on the actuator itself results from excessive wear of the actuator such that the actuator prevents further movement of the rod with respect to the housing as opposed to the parts of the vehicle determining extension and retraction.

Figure 9:
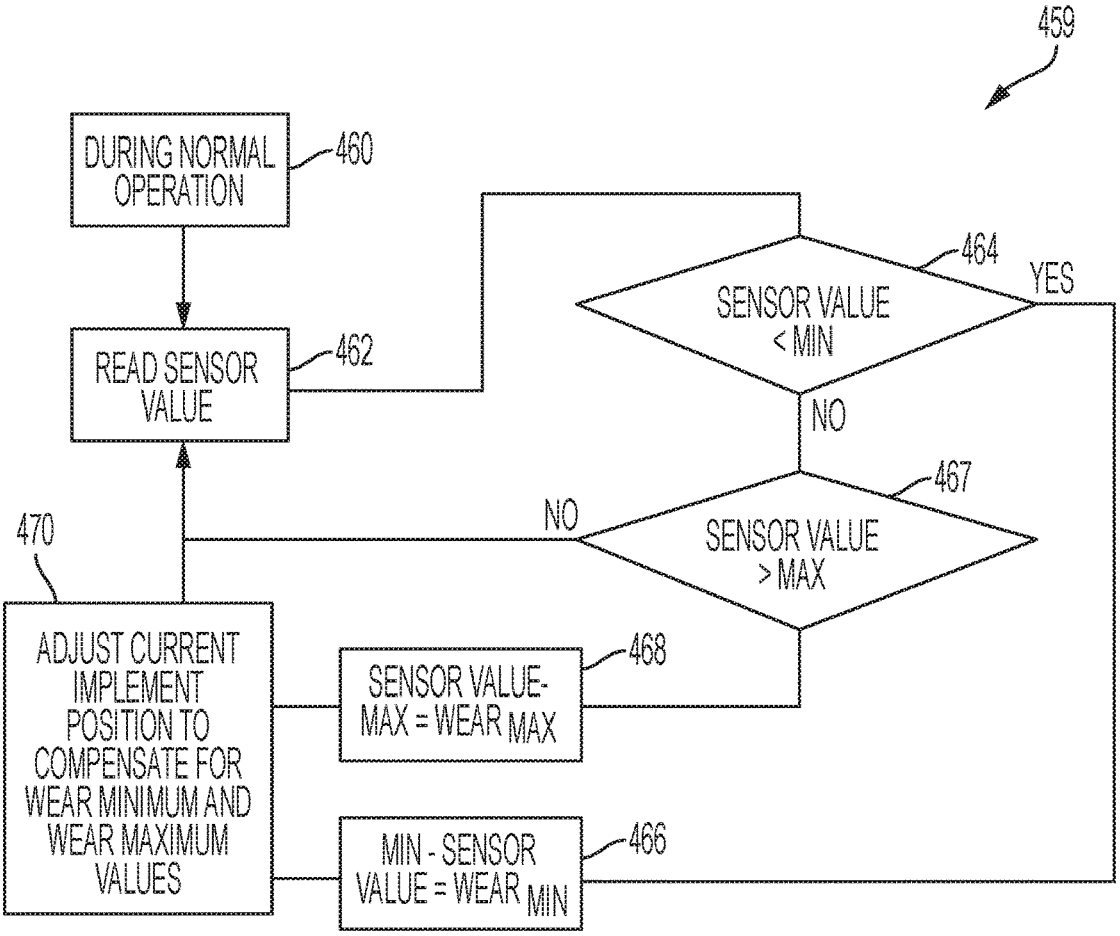
FIG. 9 is a process diagram to determine values of mechanical wear resulting from use of an actuator and the use of those mechanical wear values in adjusting a position of a work implement.

Once the minimum and maximum initial values are stored, a process 459 is performed during normal operation of the work machine beginning at block 460 of FIG. 9. As the work machine operates, and in particular as the actuator rods are extending and retracting, the location of the sensed element 424 is identified by the sensor 420 and the sensor 422 at block 462. Each of the sensors 420 and 422 identify the location of the sensed element at block 462. The sensor value identified by the sensor 420, i.e. a retracted operation value, is compared to the minimum initial value at block 464 to determine whether the retracted operation value is less than the minimum initial value. If the result of this comparison is yes, the identified retraction operation value is subtracted from the minimum initial value and set to a minimum wear value at block 466. The sensor value identified by the sensor 422, i.e. an extended operation value, is compared to the maximum initial value at block 467 to determine whether the extended operation value is greater than the maximum initial value. If the result of this comparison is yes, the extended operation value is subtracted from the maximum initial value and set to a maximum wear value at block 468.

Once the maximum wear value and the minimum wear values are determined at blocks 466 and 468, the machine controller 303 in the controller 250 adjusts the position of the implement at block 470 based on a desired grade target, which is constantly updated by the controller 250. The desired grade target is used to control the position of the blade 212 in the embodiment of FIG. 2. In one embodiment, the controller 250 adjusts the position of the blade 212 based on the desired grade target signal and an offset signal. The offset signal is either one of the minimum wear signal and the maximum wear signal generated by the controller 250 to compensate for wear in the actuators controlling positioning of the implement. The desired grade target signals are modified by the maximum and minimum wear signals to compensate for the wear that occurs to the actuator or to the machine parts.

The controller 250 adjusts the position of the implement based on the modified command signals provided by the machine controller 303 which modifies the commands provided by the machine control systems, including but not limited to sonic systems, laser systems, global positioning systems (GPS), or other systems providing grade control information. Machine control system commands are supplemented or altered by commands generated by the controller 250 based on the determined wear to the actuators or to the machine parts to which the actuators are coupled. Manually generated commands provided by an operator using manually operated controls such as implement control devices 237 are also modified as necessary.

Figure 10:
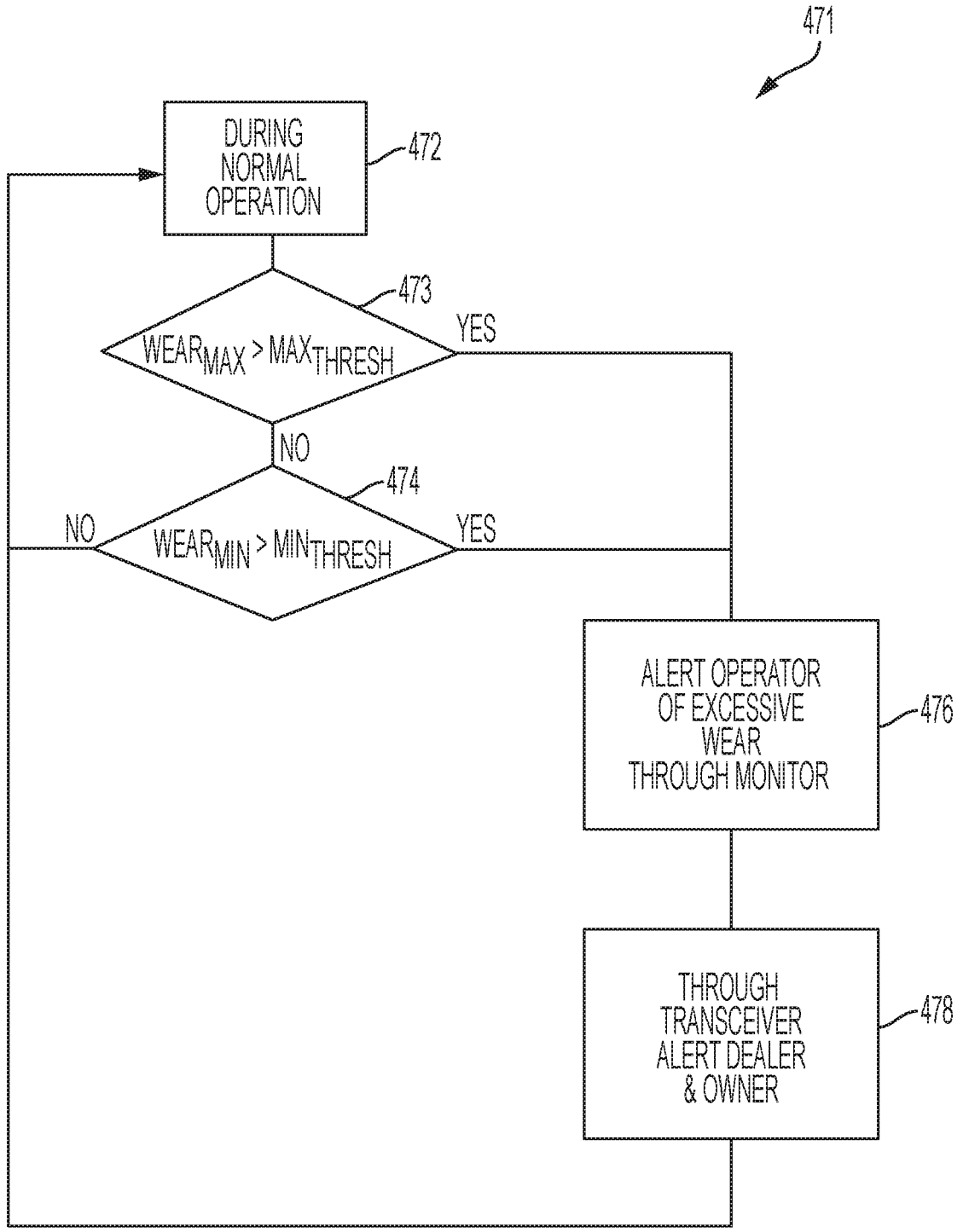
FIG. 10 is a process diagram to provide an alert if mechanical wear resulting from use of an actuator exceeds a predetermined threshold.

Once the maximum wear value and the minimum wear values are determined, an alert process 471 as described in FIG. 10 takes place. During normal operation beginning at block 472, the processor 250 compares the maximum wear value to a maximum threshold value at block 473. The processor 250 also compares the minimum wear value to a minimum wear threshold value at block 474. If the outcome of either the comparisons at blocks 473 and 474 is yes, then a wear alert signal is generated by the processor 250 and is transmitted to an alert device located at the machine monitor 307, a user interface, or at another alert device located at the workstation 238, such as illumination device or an sound generation device. Upon receipt of the transmitted alert signal, the operator is notified of excessive wear at block 476. In this embodiment, the alert signal is also transmitted to the transceiver 305, which in turn transmits the alert signal wirelessly to a work machine dealer, owner, manufacturer, or lessor at block 278.

In another embodiment, the process 459 is initiated manually by the operator who initiates the process by flipping a switch, pressing a button, selecting from a menu, or by activating other user accessible inputs available on a control panel, a display, or a user interface.

In other embodiments, operator controls, which are located in the cab 222, include an on/off switch to enable the operator to turn on or turn off the position adjustment control of the implement based on mechanical wear of the actuators and the parts to which the actuators are connected.

While exemplary embodiments incorporating the principles of the present disclosure have been described hereinabove, the present disclosure is not limited to the described embodiments. Instead, this application is intended to cover any variations, uses, or adaptations of the disclosure using its general principles. For instance, other types of work vehicles are contemplated including crawlers, excavators, and compact track loaders. Other types of implements are also contemplated including a grader ripper, a trencher, or an auger. In addition, while the terms greater than and less than have been used in making comparison, it is understood that either of the less than or greater than determines can include the determination of being equal to a value. Further, this application is intended to cover such departures from the present disclosure as come within known or customary practice in the art to which this disclosure pertains and which fall within the limits of the appended claims.

The invention claimed is:

1. A method of moving a work implement coupled to a hydraulic actuator having a cylinder and a piston rod, the hydraulic actuator coupled to the work implement and coupled to a part of a work vehicle, the method comprising:

identifying, with a sensor, one of: i) an initial retracted reference position of the piston rod based on an initial minimum retracted distance or ii) an initial extended reference position of the piston rod based on an initial maximum extended distance;

identifying, with the sensor, an end of stroke position of the piston rod after identifying one of the initial retracted reference position of the piston rod or the initial extended reference position of the piston rod; and moving the work implement with respect to the work vehicle based on a work implement command modified by the identified end of stroke position.

2. The method of claim 1 further comprising:

comparing the end of stroke position with a threshold value to generate a difference value; and transmitting an alert based on the difference value.

3. The method of claim 1 wherein the identifying, with the sensor, an end of stroke position includes identifying an end of stroke retracted position and an end of stroke extended position.

4. The method of claim 3 wherein the moving the work implement includes moving the work implement with respect to the work vehicle based on the work implement command modified by the identified end of stroke retracted position and modified by identified the end of stroke extended position.

5. The method of claim 1 further comprising:

establishing a grade target for a surface to be prepared by the work implement, wherein moving the work implement includes adjusting the position of the work implement to grade the surface to the grade target.

6. The method of claim 5 wherein moving the work implement includes moving the work implement with respect to the work vehicle by modifying the location of the piston rod with respect to the cylinder at each of the end of stroke retracted position and the end of stroke extended position to grade the surface to the grade target.

7. The method of claim 6 wherein the modifying the location of the piston rod includes transmitting a signal from a controller to the hydraulic cylinder at each of the end of stroke retracted position and the end of stroke extended position to grade the surface of the grade target.

8. The method of claim 6 further comprising:

comparing the end of stroke position with a threshold value to generate a difference value; and transmitting an alert based on the difference value.

9. The method of claim 8 wherein the transmitting the signal from the controller includes transmitting the signal over a communication network of the vehicle including one or more of a CAN network, an Ethernet network, a WIFI network, a Bluetooth network, a GPS network, a cellular network, and a satellite network.

10. A work vehicle including a work implement operatively connected to a frame, the work vehicle comprising:

an actuator operatively connected to the work implement, the actuator including a cylinder and a piston rod, wherein the actuator is configured to move the work implement with respect to the frame;

control circuitry operatively connected to the actuator, the control circuitry including a processer and a memory, wherein the memory is configured to store program instructions and the processor is configured to execute the stored program instructions to:

identify, with a sensor, an initial reference position of the piston rod based on an initial minimum retracted distance or an initial maximum extended reference position of the piston rod based on an initial maximum extended distance;

identify, with the sensor, an end of stroke position of the piston rod after identifying one of the initial retracted reference position of the piston rod or the initial extended reference position of the piston rod; and move the work implement with respect to the work vehicle based on a work implement command modified by the identified end of stroke position.

11. The work vehicle of claim 10 wherein the identify, with a sensor, an end of stroke position includes identify one of or both of an end of stroke retracted position and an end of stroke extended position.

12. The work vehicle of claim 11 wherein the move the work implement includes move the work implement with respect to the work vehicle based on the work implement command modified by one or both of the identified end of stroke retracted position and modified by the end of stroke extended position.

13. The work vehicle of claim 12 wherein the work implement command includes move the work implement in response to a grade target for a surface to be prepared by the work implement.

14. The work vehicle of claim 13 wherein moving the work implement includes moving the work implement with respect to the work vehicle by modifying the location of the piston rod with respect to the cylinder at each of the end of stroke retracted position and the end of stroke extended position to grade the surface of the grade target.

15. The work vehicle of claim 14 wherein the modifying the location of the piston rod includes transmitting a signal from a controller to the actuator at each of the end of stroke retracted position and the end of stroke extended position to grade the surface of the grade target.

16. The work vehicle of claim 15 wherein the memory is further configured to store program instructions and the processor is further configured to execute the stored program instruction to:

compare the end of stroke position with a threshold value to generate a difference value; and transmit an alert based on the difference value.

17. The work vehicle of claim 16 wherein the control circuitry further includes a communication network including one or more of a CAN network, an Ethernet network, a WIFI network, a Bluetooth network, a GPS network, a cellular network, and a satellite network operatively connected to the processor.

18. A grade control system for a work vehicle including a frame and a grader blade operatively connected to the frame and configured to move through a range of positions to grade a surface, the control system comprising:

an actuator operatively connected to the grader blade, the actuator including a cylinder, a piston rod, and a sensor to determine a position of the piston rod with respect to the cylinder, wherein the actuator is configured to move the grader blade with respect to the frame;

control circuitry operatively connected to the actuator, the control circuitry including a processer and a memory, wherein the memory is configured to store program instructions and the processor is configured to execute the stored program instructions to:

identify, with the sensor, one of: i) an initial retracted reference position of the piston rod based on an initial minimum retracted distance; or ii) an initial extended reference position of the piston rod based on an initial maximum extended distance;

identify, with the sensor, an end of stroke position of the piston rod after identifying one of the initial retracted reference position of the piston rod or the initial extended reference position of the piston rod;

identify a first position of the grader blade with respect to the surface; and move the grader blade from the identified first position to a second position, wherein the second position is based on a blade command modified by the identified end of stroke position.

19. The grade control system of claim 18 wherein the identified end of stroke position is different than one of the initial retracted reference position of the piston rod or the initial extended reference position of the piston rod due to wear.

20. The grade control system of claim 19 wherein the blade command is based on a contour instruction received from a machine control system and the processor is configured to execute the stored program instructions to:

adjust the position of the grader blade during movement of the work vehicle over the surface.

* * * * *